US007124801B2

(12) United States Patent
Ng et al.

(10) Patent No.: US 7,124,801 B2
(45) Date of Patent: Oct. 24, 2006

(54) ROMAN BLIND ASSEMBLY

(76) Inventors: Philip Ng, 25 White Blvd., Thornhill, Ontario (CA) L4J 5Z4; Xiulian Zhang, 40 Fountainhead Road, Apt. 503, Toronto, Ontario (CA) M3J 2V1; Norman Wills, 1660 Woodheng Way, Mississauga, Ontario (CA) L5N 7T2

( * ) Notice: Subject to any disclaimer, the term of this patent is extended or adjusted under 35 U.S.C. 154(b) by 97 days.

(21) Appl. No.: 10/998,006

(22) Filed: Nov. 29, 2004

(65) Prior Publication Data

US 2005/0115683 A1 Jun. 2, 2005

(51) Int. Cl.
*A47H 5/00* (2006.01)

(52) U.S. Cl. ..... 160/84.04

(58) Field of Classification Search ..... 160/84.04, 160/84.01, 84.05, 84.06, 168.1 R, 176.1 R, 160/264

See application file for complete search history.

(56) References Cited

U.S. PATENT DOCUMENTS 5,273,096 A * 12/1993 Thomsen et al. ..... 160/84.01
5,566,735 A * 10/1996 Jelic ..... 160/84.04
5,690,156 A * 11/1997 Ruggles ..... 160/84.04
5,862,850 A * 1/1999 Yang ..... 160/84.04
6,257,300 B1 * 7/2001 Brownlie ..... 160/84.01
6,402,110 B1 * 6/2002 Berman et al. ..... 248/316.2
6,662,845 B1 * 12/2003 Palmer ..... 160/84.01
6,854,500 B1 * 2/2005 Chen et al. ..... 160/84.01

* cited by examiner

*Primary Examiner*—David Purol
(74) *Attorney, Agent, or Firm*—Elias Borges

(57) ABSTRACT

An improved Roman blind assembly is disclosed. The Roman blind assembly consists of a fabric screen mounted to a pair of suspension cords and a pair of pull cords. Each of the suspension cords consists of an elongated flexible cord having a plurality of loops formed along a length of the cord, each loop being a loop of flexible cord defining a loop opening. The blind assembly also includes a plurality of elongated mounting elements mounted to the fabric screen to form a plurality of parallel folds, each of said mounting element being mounted to one of the loops of each suspension cord. Finally, the blind assembly also includes a drawing mechanism for pulling up the fabric screen by drawing up the pull cords.

16 Claims, 9 Drawing Sheets

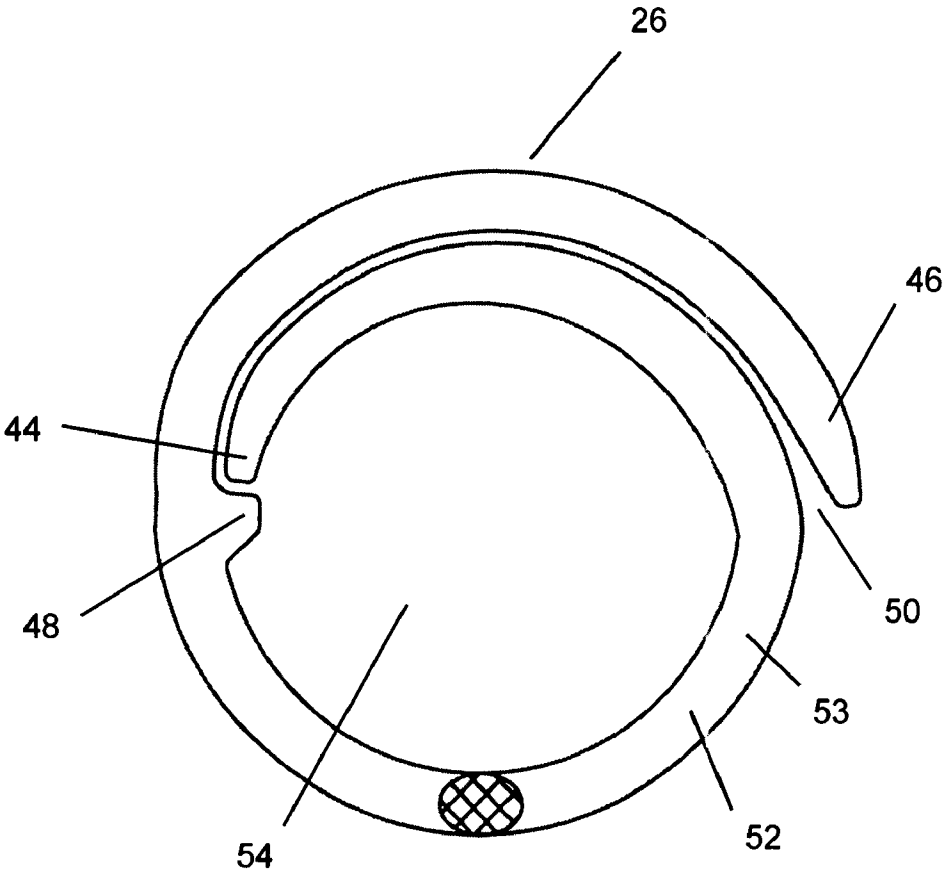
Fig. 5
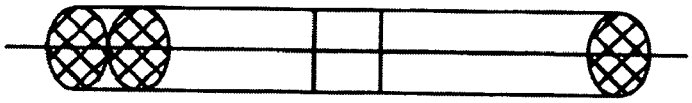

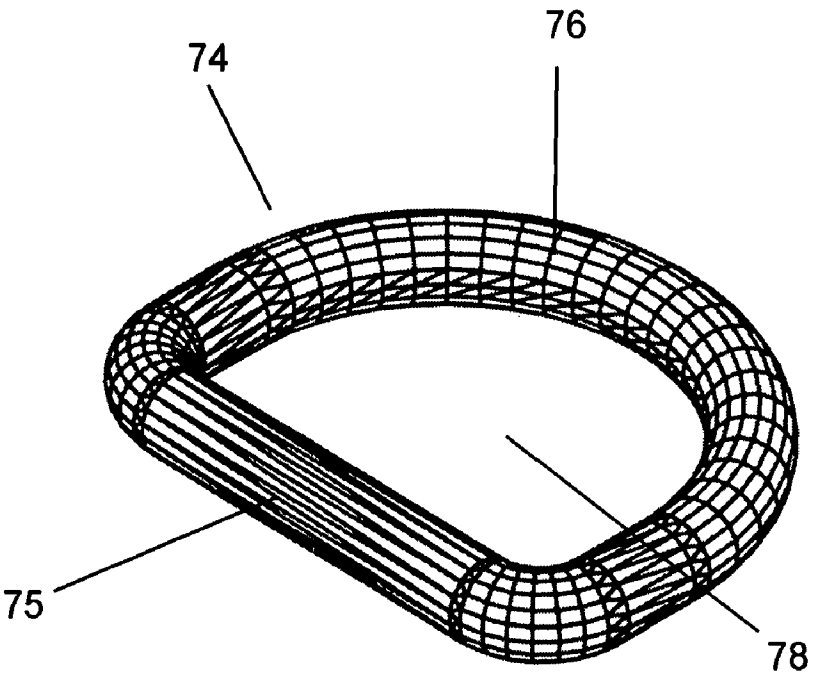
Fig. 9
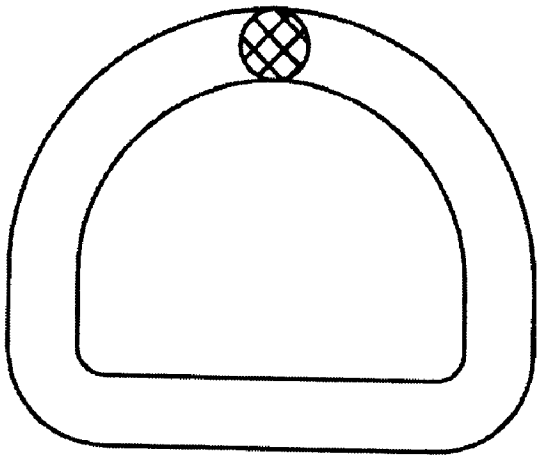

ROMAN BLIND ASSEMBLY

FIELD OF THE INVENTION

The invention relates generally to assemblies for constructing roman blinds.

BACKGROUND OF THE INVENTION

Roman blinds are a common and popular type of blind. The roman blind generally consists of a substantially flat sheet of fabric which is mounted to a plurality of parallel horizontal bars suspended from at least one pair of suspension cords. The fabric is arranged in a series of horizontal folds with the bars providing structural support for the folds of fabric. The suspension cords are suspended from a head assembly, which controls the lifting and lowering of the suspension cords. Lifting or lowering the suspension cords causes the bars to lift and lower, thereby drawing up the fabric screen or lowering it.

Mounting the suspension bars to the fabric screen and to the suspension cords is an important and often time consuming step in assembling roman blinds. Traditionally, the suspension bars were contained in sleeves sewn into the fabric screen. More recently, designs have been introduced which include a bracket for mounting the suspension bars to the fabric screen. These brackets often include a hollow C shaped tube made of a flexible material, such as plastic. The C shaped tube has a cavity dimensioned to fit tightly over the suspension bar. To mount the fabric screen to the suspension bar, the fabric is first folded over the suspension bar and then the fabric wrapped bar is forced into the cavity of the C shaped mounting bracket. The mounting bracket grasps the suspension bar tightly, thereby securing the suspension bar to the fabric screen. The fabric is firmly held between the C shaped tube and the suspension bar. The mounting bracket may then be attached to the suspension cord. However, mounting the bracket to the suspension cord is still a time consuming operation. Therefore, an improved roman blind assembly which simplifies the procedure for mounting the bars to the suspension cords is still required.

SUMMARY OF THE INVENTION

In accordance with the present invention, there is provided a Roman blind assembly consisting of a fabric screen mounted to a pair of suspension cords. Each of the suspension cords consists of an elongated flexible cord having a plurality of loops formed along a length of the cord, each loop being a loop of flexible cord defining a loop opening. The blind assembly also includes a plurality of elongated mounting elements mounted to the fabric screen to form a plurality of parallel folds, each of said mounting element being mounted to one of the loops of each suspension cord. Finally, the blind assembly also includes a drawing mechanism for pulling up the fabric screen by drawing up the pull cords.

With the foregoing in view, and other advantages as will become apparent to those skilled in the art to which this invention relates as this specification proceeds, the invention is herein described by reference to the accompanying drawings forming a part hereof, which includes a description of the preferred typical embodiment of the principles of the present invention.

DESCRIPTION OF THE DRAWINGS

FIG. 5. is a perspective view of the connector ring of the present invention.

FIG. 9. is a perspective view of the connector ring portion of the alternate embodiment of the present invention shown in FIG. 7

In the drawings like characters of reference indicate corresponding parts in the different figures.

DETAILED DESCRIPTION OF THE INVENTION

Figure 1:
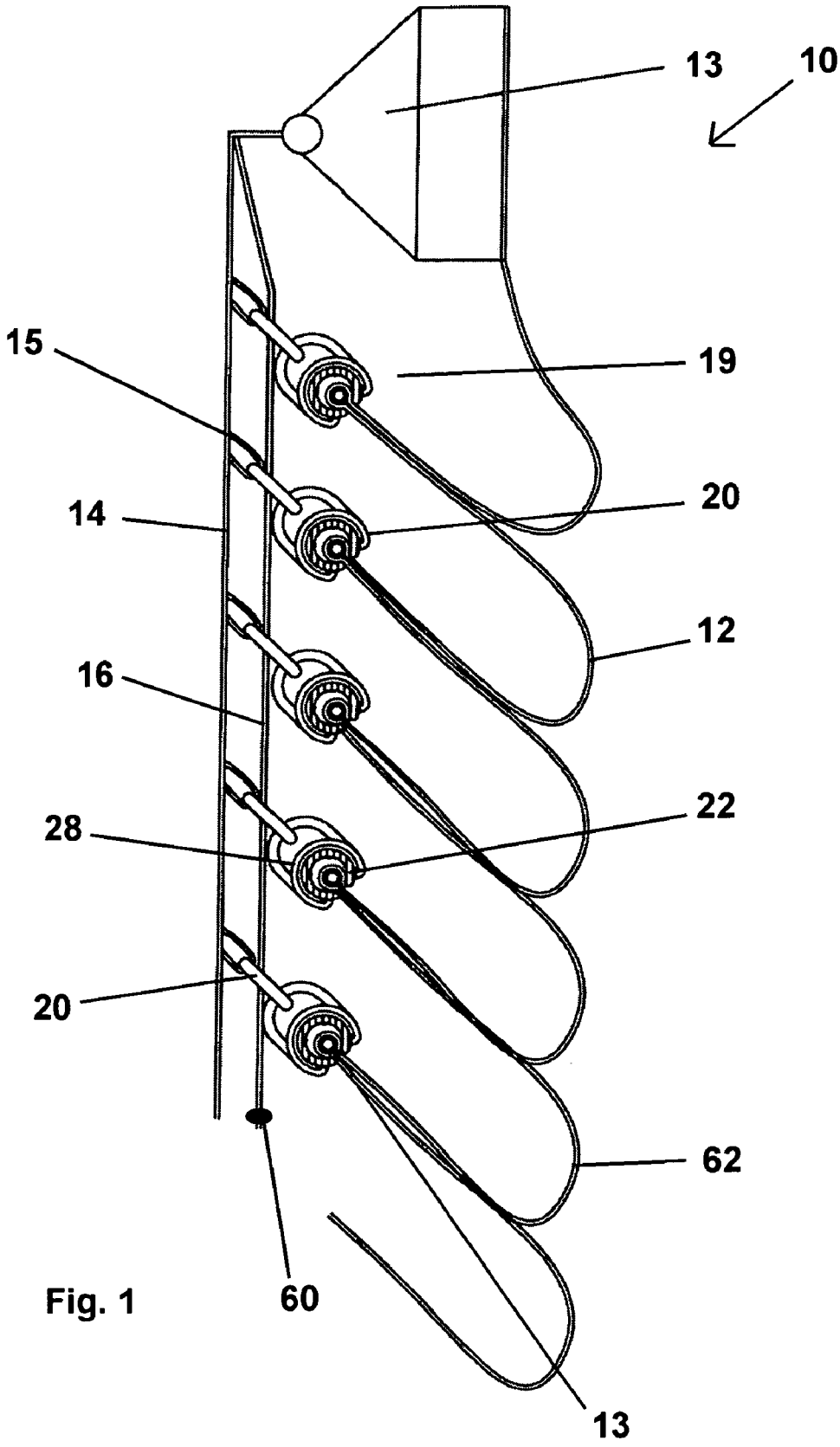
FIG. 1. is a side view of a Roman blind assembly made in accordance with the present invention.

Referring firstly to FIG. 1, the present invention consists of a roman blind assembly, shown generally as item 10 which is made of several components, namely a fabric screen 12, a first pair of suspension chords 14 (referred to as loop cords or hobble cords) a second pair of suspension cords 16 (referred to as pull cords), and a plurality of mounting means 19 for mounting the fabric screen to both the first and second pairs of suspension cords. The hobble cords each have a plurality of primary mounting elements 15 spaced along the cords. A drawing mechanism 13 is provided to draw up the fabric screen by pulling up suspension cords 16.

Figure 6:
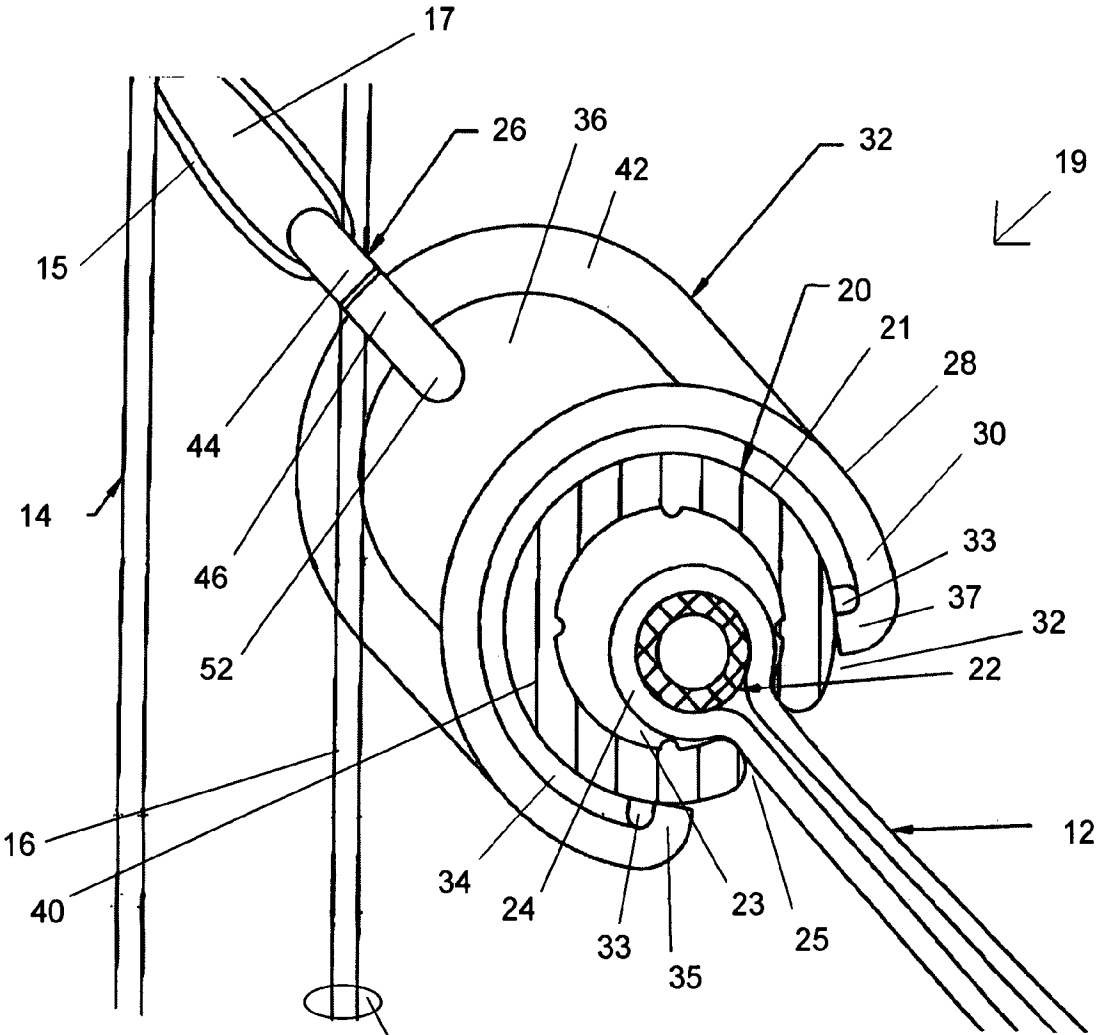
FIG. 6. is an enlarged side view partly in cross section of the Roman blind assembly shown in FIG. 1.

Referring now to FIG. 6, each mounting means 19 consists of a first mounting bracket 20, a cylinder 22, detachable ring 26 and a second mounting bracket 28. Each mounting bracket 20 is essentially an elongated C shaped clamp having outer surface 21 and cavity 23. Preferably, cavity 23 is dimensioned and configured to receive cylinder 22 such that a portion 24 of screen 12 may be firmly retained within the C shaped clamp formed on the bracket when the cylinder is inserted into the clamp. The outer surface 21 of mounting bracket 20 may include a plurality of elongated ridges 33 which extend longitudinally along the length of the mounting bracket. Each second mounting bracket 28 includes a clamp portion 30 and a connector portion 32. Clamp portion 30 is essentially a C shaped clamp having an opening 32, an internal cavity 34, and opposite ends 35 and 37. Mounting bracket 28 is made of a resilient material and opening 32 and internal cavity 34 are dimensioned and configured to snugly receive and retain mounting bracket 20. Preferably, opposite ends 35 and 37 are slightly hooked to grasp ridges 33 of mounting bracket 20 in order to more securely retain mounting bracket 20 within cavity 34. Connector portion 32 of second mounting bracket 28 is formed as a loop of material having opening 36. Opening 36 is dimensioned to receive detachable ring 26.

Figure 2:
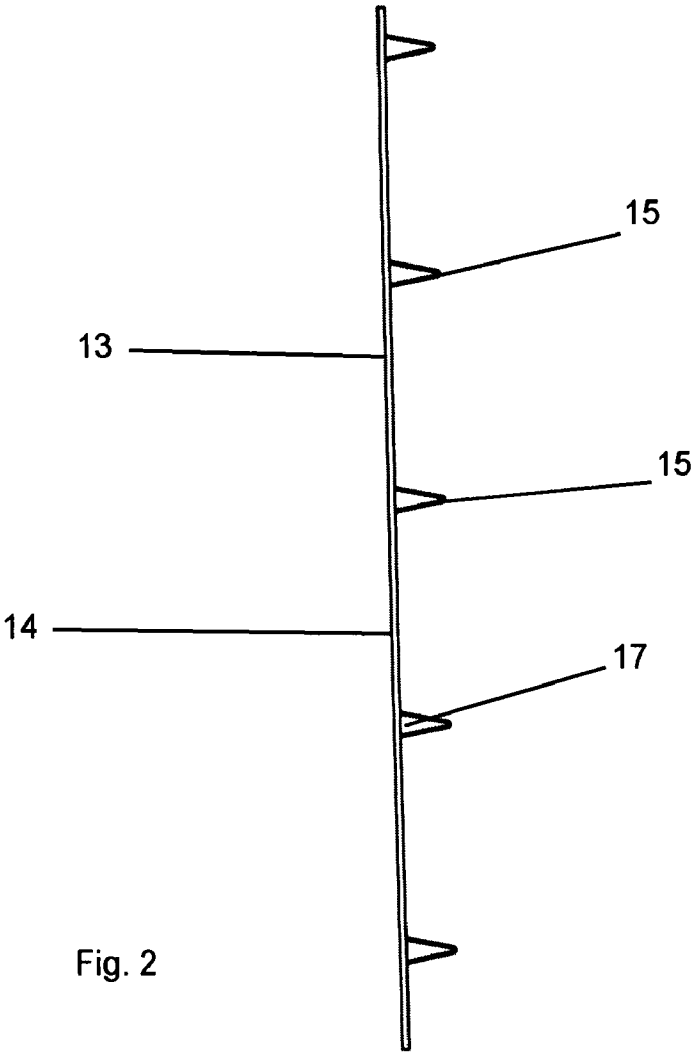
FIG. 2. is a side view of the loop cord portion of the present invention.

Referring now to FIG. 2, hobble cord 14 consist of an elongated ribbon 13 having a plurality of primary connector elements 15 attached thereto. Primary connector elements 15 are formed as loops of chord. Loops 15 are equally spaced along ribbon 13. Preferably, loops 15 are separated by a distance of several centimeters, depending on the size of the roman folds desired in the final roman blind. Loops 15 each have an opening 17. Preferably, opening 17 will have a diameter of approximately one or two centimeters, which will be sufficient to receive detachable ring 26 (see FIG. 1). Ribbon 13 may be made of cotton or a synthetic material. Loops 15 must be sufficiently strong to support the weight of the roman blind. Suitable ribbons having preformed spaced apart loops are readily available on the market. While the preferred form of the connector element is a loop of cord, it will be appreciated that other types of connector elements may be used in place of the cord loops.

Figure 3A:
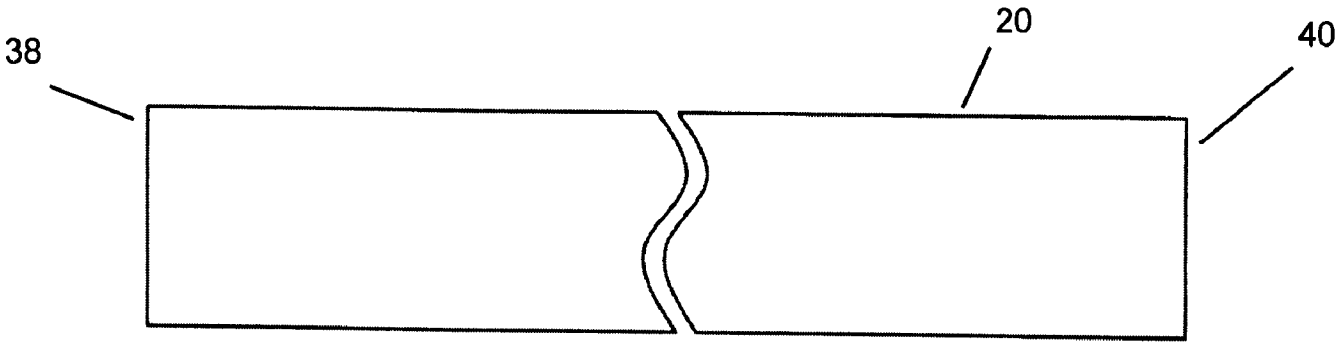
FIG. 3*a*. is a side view of the first bracket portion of the present invention.
Figure 3B:
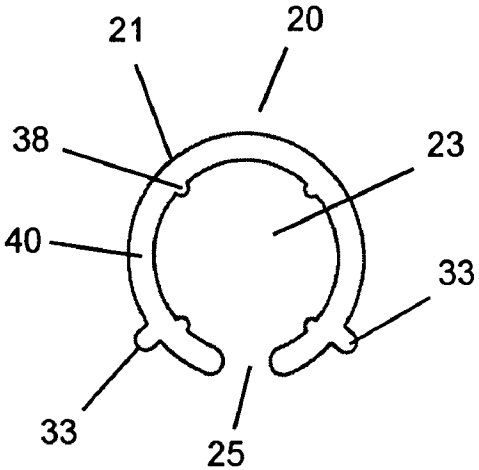
FIG. 3*b*. is a cross sectional view of the first bracket portion of the present invention.
Figure 3C:
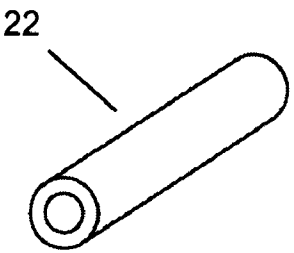
FIG. 3*c*. is a side view of the cylinder portion of the present invention.

Referring now to FIGS. 3*a*, 3*b* and 3*c*, bracket 20 consists of a straight elongated tube like structure having opposite ends 38 and 40 and cylinder 22 consists of an elongated cylindrical tube. The length of bracket 20 and cylinder 22 are identical and are selected to match the width of the fabric screen (not shown) to be used to make the blind. Bracket 20 consists of a C shaped clamp having elongated slot like opening 34 and internal cavity 36. Elongated protrusions 38 are formed on the C shaped clamp and project into cavity 23. Slot opening 25 extends the entire length of bracket 20 and is dimensioned to be slightly smaller than the diameter of cylinder 22. Preferably, slot 25 will have a diameter of approximately 2.5 cm. The diameter of internal cavity 23 is dimensioned to be slightly greater than the diameter of cylinder 22. Preferably, cavity 23 will have a diameter of approximately 9 mm and cylinder 22 will have a diameter of approximately between 4 mm and 6 mm. Bracket 20 is made of an extruded flexible material such as polyethylene or some other flexible plastic. Bracket 20 has wall 40 which defines cavity 23. Preferably the material forming bracket 20 is selected to be sufficiently flexible to permit wall 40 to bend sufficiently to allow cylinder 22 to be inserted into cavity 23 though opening 25. The material forming bracket 20 is further selected to be sufficiently resilient to permit wall 40 to return to their original position after cylinder 22 has been inserted into cavity 23 and to securely hold the cylinder in the cavity. Outside surface 21 of bracket 20 has a plurality of ridges 33 which extend longitudinally along the entire length of bracket 20. Preferably, ridges 33 are positioned adjacent opening 25.

Figure 4B:
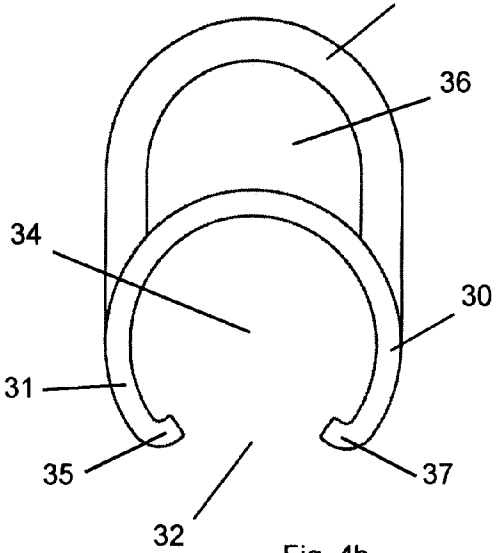
FIG. 4*b*. is a cross sectional view of the second bracket portion of the present invention.
Figure 4C:
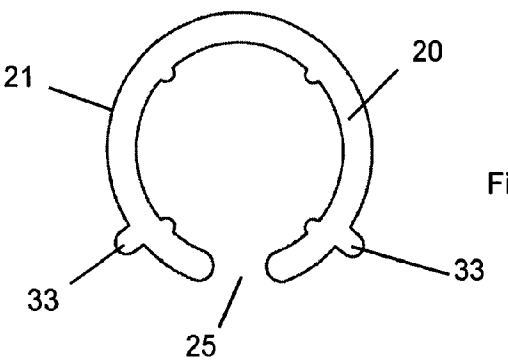
FIG. 4*c*. is a cross sectional view of the first bracket portion of the present invention.
Figure 4A:
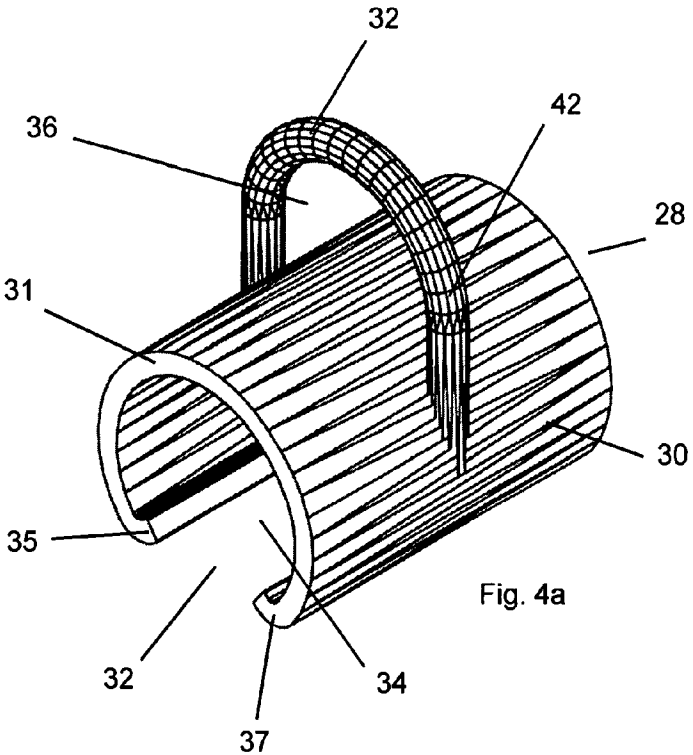
FIG. 4*a*. is a perspective view of the second bracket portion of the present invention.

Referring now to FIGS. 4*a*, 4*b* and 4*c*, second bracket 28 consists of two parts, namely a connector portion 32 and a C shaped clamp portion 30. Connector portion 32 includes an arch shaped projection 42 which defines an opening 36. Connector portion 32 is dimensioned and configured such that detachable ring 26 (see FIG. 6) may be retained within opening 36 of the connector portion. Clamp portion 30 is formed as a C shaped clamp which is dimensioned and configured to receive and retain bracket 20. In particular, cavity 34 is dimensioned to be slightly wider than the outside diameter of first bracket 20. Portion 30 has wall 31 which defines cavity 34. Wall 31 is made of a sufficiently flexible material and the diameter of opening 32 is selected to permit first bracket 20 to be inserted through opening 32 and into cavity 34. The material forming wall 31 is selected to be sufficiently resilient such that after first bracket 20 is inserted into cavity 34, the wall returns to its original shape to retain the first bracket within cavity 34. The thickness of wall 31 and the resiliency of the material forming the wall are selected to ensure that the first bracket is firmly retained within cavity 34 after it has been inserted into clamp portion 30. Preferably, second bracket 28 is made of a plastic material such as polyethylene and wall 31 has a thickness of approximately 2 millimeters. Ends 35 and 37 are formed on the ends of wall 31 adjacent opening 32. Preferably, clamp portion 30 and first bracket 20 are dimensioned such that ends 35 and 37 are positioned adjacent opening 25 of bracket 20 when bracket 20 is fully inserted into clamp portion 30. When bracket 20 is fully inserted into clamp 30, ends 35 and 37 resist the removal of bracket 20 from cavity 34. Preferably hooks are formed on ends 35 and 37. Hooked ends 35 and 37 are preferably dimensioned to engage ridges 33 of first bracket 20 when bracket 20 is moved out of cavity 34, thereby permitting second bracket 28 to more securely hold first bracket 20.

Referring now to FIG. 5, detachable ring 26 consists of an elongated and coiled member 52 having opposite ends 44 and 46 and middle portion 53. Member 52 is made of a highly resilient material which can easily be deformed but which will recoil back into its original shape as shown in FIG. 5. Coiled member 52 is formed as a tightly coiled circle with end 44 positioned towards opening 54 relative to end 46. End 46 is spaced from middle portion 53 of member 52 by gap 50. Gap 50 is dimensioned to guide a loop of string (not shown) to be inserted between middle portion 53 and end 46. Member 52 includes a stop portion 48 which is dimensioned and configured to prevent anything (such as a loop of string) from passing from opening 54 past end 44. The diameter of end 46 of member 52 is dimensioned to pass through openings 36 of second bracket 28 and opening 17 of loop 15 (see FIG. 6).

How the various parts are assembled to form a roman blind will now be discussed with reference to FIG. 6. Fabric 12 is first folded into horizontal folds by placing cylinder 22 along fabric folds 24 and wrapping the fabric fold around the cylinder. The fabric enclosed cylinder is then mounted to bracket 20 by forcing the fabric wrapped cylinder through opening 25. As the fabric wrapped cylinder is forced through opening 25, wall 40 flexes, permitting the cylinder to enter cavity 23. Wall 40 then springs back to is original position, thereby trapping cylinder 22 within cavity 23 and thereby holding the fabric to first mounting bracket 20.

First mounting bracket 20 is then mounted to second mounting bracket 28 by forcing bracket 20 through opening 32. As bracket 20 is forced through opening 32, wall 30 flexes, causing opening 32 to widen and permitting the bracket to be inserted into cavity 34. Bracket 20 is pushed all the way into cavity 34 such that ridges 33 are positioned inside cavity 34. Wall 30 then springs back to its original position thereby trapping first mounting bracket 20 within cavity 34 of second mounting bracket 28. Hooked ends 35 and 37 prevent bracket 20 from being removed from bracket 28 by bearing against ridges 33.

Second bracket 28 is then mounted to loop 15 of hobble cord 14 via ring 26. Coiled member 52 is opened up slightly and end 46 is passed through opening 17 of loop 15 and opening 36 of connector portion 32 of bracket 28. Loop 15 and connector portion 32 are then pushed past end 44 and stop 48 (see FIG. 5) such that the loop and connector are retained in opening 54 of ring 26. Ring 26 and the first and second brackets make it much easier and quicker to assemble the roman blind. Since loops 15 are preformed on hobble cord 14, mounting brackets 28 to the hobble cord is very quick and requires little labor. The procedure is repeated for each hobble cord and each pull cord and for each fold of the roman blind. The final step is to attach a stop 60 to the end of pull cord 16. Stop 60 is dimensioned and configured to not pass though ring 26. Therefore, by lifting up pull cords 16 the lowermost folds of the assembled roman blind are lifted up.

Referring back to FIG. 1, when fully assembled, individual fabric folds 62 are supported on hobble cord 14 by attachment means 19. Since loops 15 are preformed on hobble cord 14, the processes of assembling the roman blind is made very easy and requires very little labor.

Figure 7:
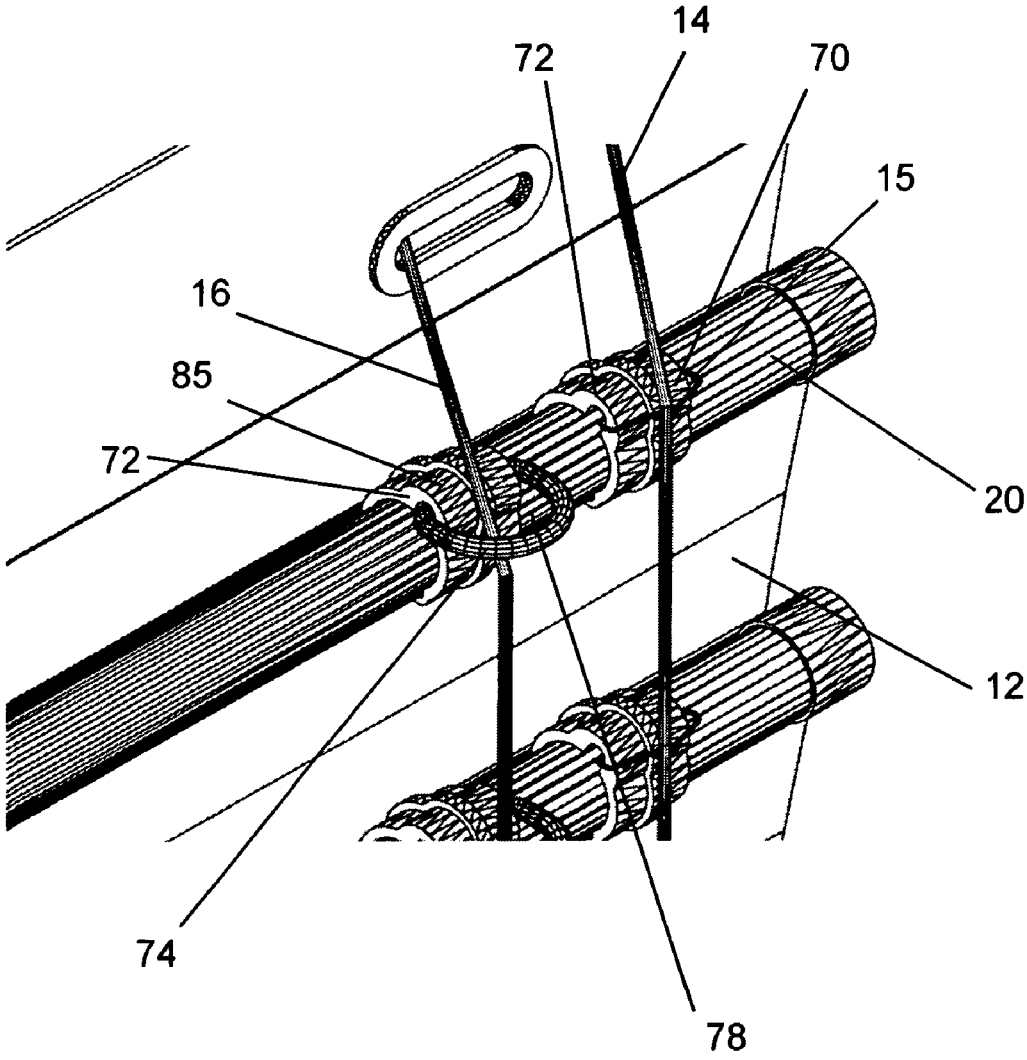
FIG. 7. is a perspective view of an alternate embodiment of the present invention.
Figures 8A, 8B, 8C:
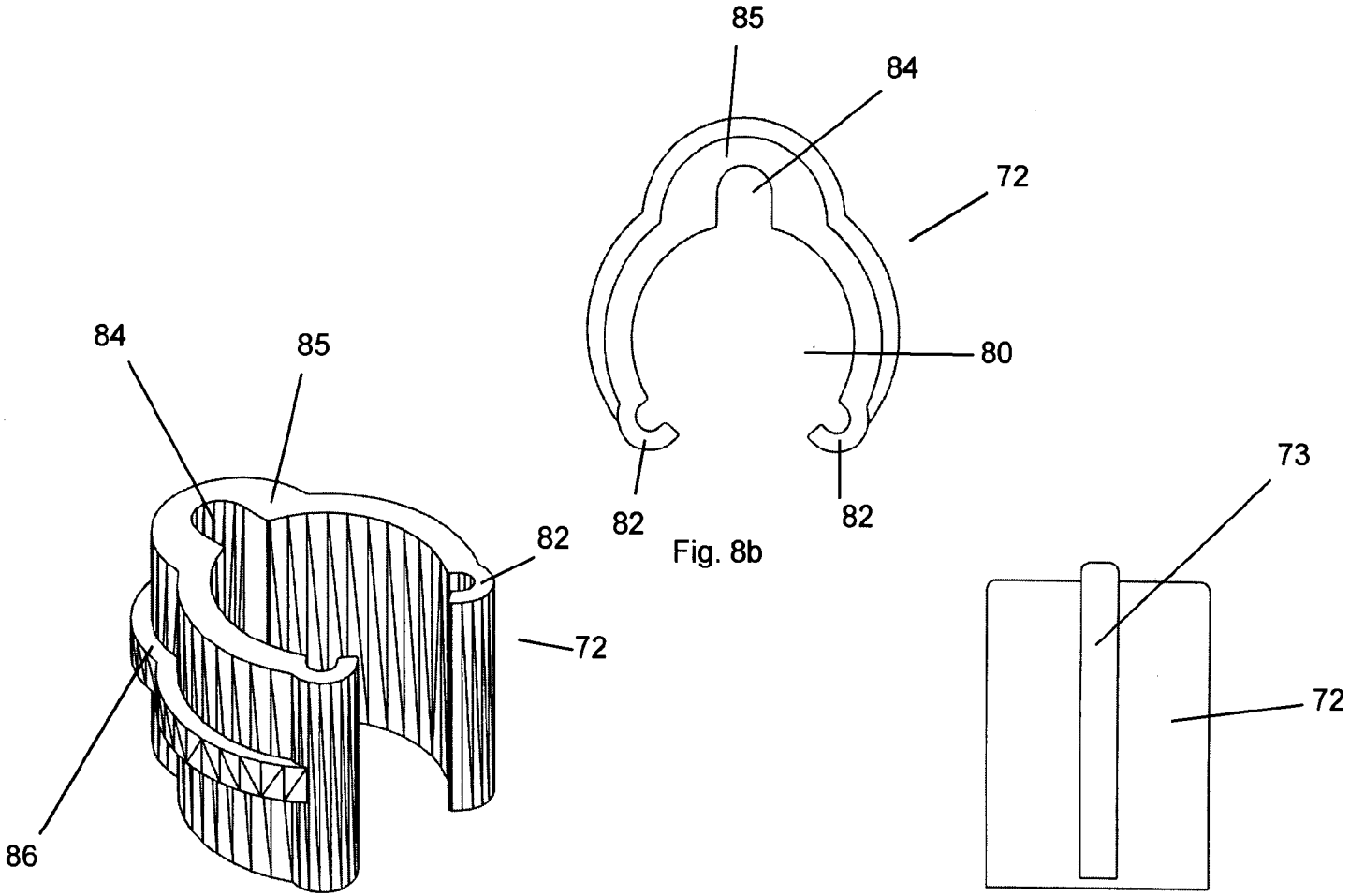
FIG. 8*a*. is a perspective view of the second mounting bracket of the alternate embodiment of the present invention shown in FIG. 7.
FIG. 8*b*. is a front view of the second mounting bracket of the alternate embodiment of the present invention shown in FIG. 7.
FIG. 8*c*. is a side view of the second mounting bracket of the alternate embodiment of the present invention shown in FIG. 7.

Referring now to FIG. 7, an alternate means for mounting the first bracket 20 to cords 14 and 16 is shown as mounting assembly 70. Mounting assembly 70 consists of a C shaped mounting bracket 72 and a D shaped ring 74. As best seen in FIGS. 8*a*, 8*b* and 8*c*, bracket 72 consists of a generally C shaped member having central opening 80, hooked ends 82, reinforcing rib 86 and arched portion 85 having recess 84. Opening 80 is dimensioned and configured to snugly receive bracket 20 (see FIG. 3*b*) of the previous embodiment. Hooked ends 82 are configured to hook to projections 33 of bracket 20 and reinforcing rib 86 ensures that hooked ends 82 are not forced apart. Arched portion 85 has recess 84 which is dimensioned to retain D ring 74.

Referring now to FIG. 9, D ring 74 consists of a D shaped ring having opening 78, straight portion 75 and curved portion 76. Straight portion 75 is dimensioned to be snugly received in recess 84 of bracket 72 (see FIG. 8*b*).

Referring back to FIG. 7, to assemble a roman blind using the brackets of the second embodiment, fabric screen is first mounted via brackets 20 as in the previous embodiment. D rings 74 are then threaded onto cord 16 and brackets 72 are then passed through openings 78 of the D rings in order to secure the straight portions of the D rings to arched portions 85 of brackets 72. To attach brackets 72 to looped cord 14, brackets 72 are threaded through loops 15 such that the loop is retained in the arched portion of the bracket. After brackets 72 are attached to cords 16 and 14, brackets 72 are then slid over brackets 20. Brackets 20 are thereby secured to cords 16 and 14 with a minimum of effort.

A specific embodiment of the present invention has been disclosed; however, several variations of the disclosed embodiment could be envisioned as within the scope of this invention. It is to be understood that the present invention is not limited to the embodiments described above, but encompasses any and all embodiments within the scope of the following claims.

Therefore, what is claimed is:

1. A Roman blind assembly comprising:

a) a fabric screen, b) a plurality of pull cords and a plurality of suspension cords, each suspension cord comprising an elongated flexible cord having a plurality of loops formed along a length of the cord, each loop being a loop of flexible cord defining a loop opening, c) a plurality of elongated mounting elements mounted to the fabric screen to form a plurality of parallel folds, d) each said mounting element being mounted to one of the loops of each suspension cord, and e) a drawing mechanism for pulling up the fabric screen by drawing up the pull cords.

2. The Roman blind assembly of claim 1 wherein the loops of each suspension cord are equally spaced along the cord.

3. The Roman blind assembly of claim 2 wherein each mounting element is mounted to the loop by a ring.

4. The Roman blind assembly of claim 3 wherein the ring comprises a split ring.

5. The Roman blind assembly of claim 4 wherein the split ring is formed from an elongated member having opposite ends and a middle, the elongated member being formed into a planar spiral coil.

6. The Roman blind assembly of claim 5 wherein the mounting elements comprise a plurality of first and second mounting brackets, each of said first mounting brackets comprising an elongated bracket having a C shaped profile and an internal cavity, the cavity dimensioned to receive a portion of the fabric screen, the fabric screen being retained in the cavity by an elongated rod dimensioned to fit within the cavity.

7. The Roman blind assembly of claim 6 wherein each of the second mounting brackets comprise a C shaped member having an internal cavity dimensioned and configured to retain the first mounting bracket.

8. The Roman blind assembly of claim 7 wherein the second mounting bracket further comprises a connector portion, the connector portion comprising a looped member having an opening.

9. The Roman blind assembly of claim 8 wherein the second mounting bracket is mounted to one of the rings by the looped member.

10. The Roman blind assembly of claim 2 wherein the mounting elements comprise a plurality of first and second mounting brackets, each of said first mounting brackets comprising an elongated bracket having a C shaped profile and an internal cavity, the cavity dimensioned to receive a portion of the fabric screen, the fabric screen being retained in the cavity by an elongated rod dimensioned to fit within the cavity.

11. The Roman blind assembly of claim 10 wherein the first mounting brackets each have a pair of ridges extending parallel along an outside surface of the first bracket.

12. The Roman blind assembly of claim 11 wherein the second bracket comprises a C shaped bracket having an internal cavity dimensioned to receive the first mounting bracket.

13. The Roman blind assembly of claim 12 wherein the second mounting bracket has hooked ends configured to engage the parallel ridges of the first mounting bracket.

14. The Roman blind assembly of claim 13 wherein the second mounting bracket has an arched portion having a recess, the recess being continuous with the cavity of the second mounting bracket.

15. The Roman blind assembly of claim 14 wherein the second mounting bracket are mounted to the pull cord by a plurality of D shaped rings, said D shaped rings dimensioned and configured to be retained in the recess of the second mounting bracket.

16. The Roman blind assembly of claim 14 wherein the second mounting brackets are mounted to the loops of the suspension cord by threading the cords through the loops and retaining the loop in the recess of the second mounting brackets.

* * * * *